United States Patent [19]

Ham

[11] Patent Number: 4,722,515

[45] Date of Patent: Feb. 2, 1988

[54] ATOMIZING DEVICE FOR VAPORIZATION

[75] Inventor: Mooyoung Ham, Glens Falls, N.Y.

[73] Assignee: Spectrum Control, Inc., Erie, Pa.

[21] Appl. No.: 850,427

[22] Filed: Apr. 8, 1986

Related U.S. Application Data

[63] Continuation of Ser. No. 668,918, Nov. 6, 1984, abandoned.

[51] Int. Cl.[4] ..... B01F 3/04; B01F 7/26; B01F 15/06

[52] U.S. Cl. ..... 261/142; 219/273; 239/224; 261/89; 261/90; 261/DIG. 65

[58] Field of Search ..... 261/89, 90, 142, 141; 219/271-275; 425/8; 264/8; 239/223, 224

[56] References Cited

U.S. PATENT DOCUMENTS

| | | | |
|---|---|---|---|
| Re. 30,285 | 5/1980 | Babington | 261/DIG. 65 |
| 1,318,774 | 10/1919 | La Bour | 239/224 X |
| 2,048,888 | 7/1936 | Ott | 261/89 |
| 2,229,313 | 1/1941 | Snyder | 261/89 X |
| 2,313,976 | 3/1943 | Sullivan et al. | 261/89 X |
| 3,130,066 | 4/1964 | Brady | 239/224 X |
| 3,192,167 | 6/1965 | Ogawa et al. | 261/89 X |
| 3,193,261 | 7/1965 | Nesbitt | 261/89 X |
| 3,358,931 | 12/1967 | Wirth | 239/224 X |
| 3,439,477 | 4/1969 | Pyne et al. | 261/89 X |
| 3,620,509 | 11/1971 | Roman | 261/89 X |
| 3,902,857 | 9/1975 | Van der Mey et al. | 261/90 X |
| 3,904,713 | 9/1975 | Boler | 239/224 X |
| 3,978,174 | 8/1976 | Peer | 261/89 X |
| 4,264,539 | 4/1981 | Berg | 261/142 |
| 4,323,524 | 4/1982 | Snowden | 264/8 |
| 4,338,876 | 7/1982 | Norton | 239/224 X |

*Primary Examiner*—Richard L. Chiesa
*Attorney, Agent, or Firm*—Christie, Parker & Hale

[57] ABSTRACT

A liquid vaporizing apparatus having a cylindrical heated vaporizing surface against which atomized droplets of liquid are thrown by a spinning disk; the disk receiving a continuous thin film of liquid from a capillary tube spaced from the disk so that a fluid drop fed from the tube end is contacted by the disk to roll the drop while pulling a liquid film from the drop, the liquid being continuously replenished from the tube.

2 Claims, 8 Drawing Figures

TIME INCREASING

ATOMIZING DEVICE FOR VAPORIZATION

CROSS REFERENCE TO RELATED APPLICATIONS

This is a continuation of application Ser. No. 668,918 filed Nov. 6, 1984, now abandoned.

This invention relates generally to converting liquids into gaseous form and more particularly concerns atomizing liquids for flash vaporization.

U.S. application Ser. No. 620,647, filed June 14, 1984, now abandoned, on Miniature Monolithic Multi-Layer Capacitor and Apparatus and Method of Making, discloses methods and apparatus for making miniature electrical capacitors. The process involves vapor deposition in a deep vacuum environment, and one material that is deposited is a resin in monomer form that, when deposited and cured, forms the dielectric layers of a monolithic capacitor structure.

The techniques of flash vaporization, i.e., subjecting small particles of liquid to vaporization heat for almost instantaneous vaporization, allows the resin to remain in monomer form through the process of being deposited, and then the capacitor making process cures and cross-links the material. As just suggested, flash vaporization depends on creating very small particles, i.e., atomizing, the liquid material. One way of creating liquid droplets is to feed liquid onto the surface of a rapidly spinning disk. The liquid is broken into droplets and thrown peripherally. A series of liquid drops can be easily generated utilizing a capillary tube and allowing surface tension to control the flow.

However, if the droplets generated by the spinning disk are being flash vaporized and the resultant gas vapor deposited to create a thin film, dropping discrete drops onto the disk would create intermittent splashes and resulting pulsations in the gas vapor being formed and deposited, making it very difficult to achieve a uniform vapor flow and a uniform coating. If, instead of discrete drops, a continuous flow is established onto the spinning disk, even if very small diameter capillary tubes constrict the flow, the flow rate can still be expected to be too high to generate vapor for the thin vapor deposited coatings sought.

Accordingly, it is an object of the invention to provide a liquid atomizing device that creates a very low but constant liquid flow for being dispersed or atomized in a vaporization apparatus. A related object is to provide a device of the foregoing kind that is suitable for handling liquids of varying viscosity.

Another object is to provide a device as characterized above that is inexpensive to manufacture and maintain.

BRIEF DESCRIPTION OF THE DRAWINGS

Other objects and advantages of the invention will become apparent upon reading the following detailed description and upon reference to the drawing, in which.

DETAILED DESCRIPTION OF THE DRAWINGS

Figure 1:
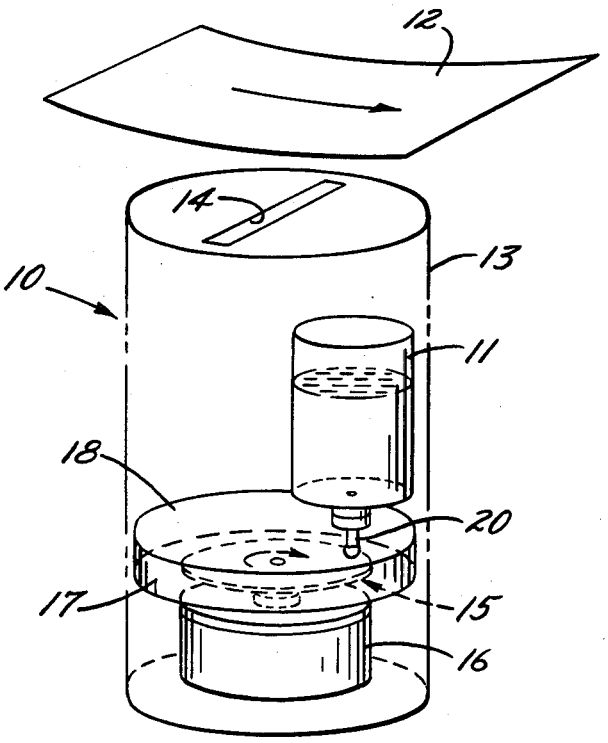
FIG. 1 is a schematic perspective of an apparatus embodying the present invention.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning to the drawing, there is shown an apparatus 10 for vaporizing a liquid, such as a monomeric resin, supplied in a reservoir 11 and depositing by condensation the resulting vapor on a substrate 12 arranged to move past the apparatus 10. It will be understood that both the apparatus 10 and the substrate 11 are maintained in a low vacuum environment. The intent of the vapor deposition is to deposit a uniform, very thin—one micron or less—coating of the liquid material on the substrate 12. A process in which the apparatus 10 can find utility is disclosed in said application Ser. No. 620,647, which is hereby incorporated by reference.

The apparatus includes a vaporization chamber 13 formed with a nozzle opening 14 for emitting the vaporized material in close proximity to the substrate 12. The chamber 13 encloses a spinning disk 15 driven by a motor 16 which throws by centrifugal force atomized droplets of fluid against a band heater 17 defining a heating surface 18 surrounding the disk 15. The tiny droplets are flash vaporized upon contact with the heated surface 18, thereby developing both vapor and vapor pressure to expel the gaseous material through the nozzle opening 14 for condensation on the substrate 12. When the fluid is a monomeric liquid, the flash vaporization preserves the chemical structure, and the condensed monomer film on the substrate can be later cured, if desired, by any suitable technique such as applying ultraviolet or electron beam radiation.

Figure 2:
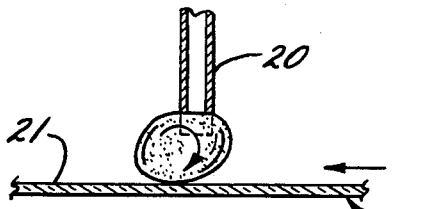
FIG. 2 is an enlarged fragmentary section of a portion of the apparatus shown in FIG. 1 illustrating the operating phenomenon created.
Figure 4:
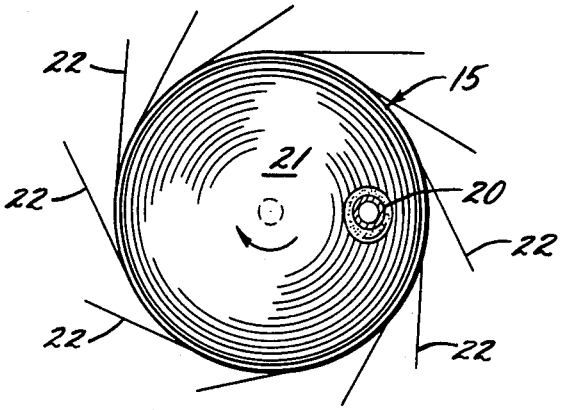
FIG. 4 is similar to FIG. 3 but illustrates the droplet dispersion resulting from operation of the apparatus.
Figure 5A:
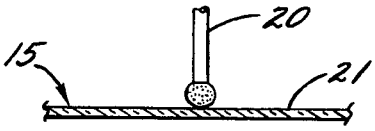
FIGS. 5A through D are similar to FIG. 2 but show a different phenomenon resulting from a different structural relationship.
Figure 5B:
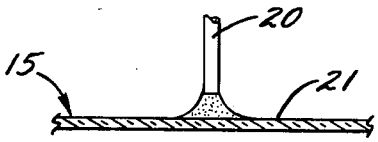
Figure 5C:
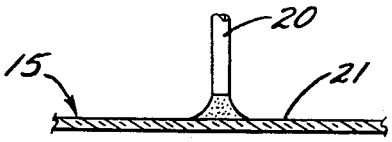
Figure 5D:
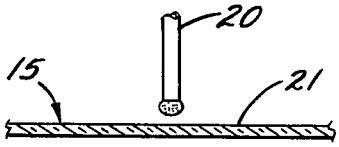

In accordance with the invention, the atomizing device includes, in addition to the driven disk 15, a capillary tube 20 mounted on the reservoir 11 for delivering fluid at right angles to the flat circular face 21 of the disk 15, and the end of the tube 20 is spaced from the face 21 so that a liquid drop formed at the tube end is just contacted by the face. With the proper spacing, disk face speed and drop size, the face rotates the drop as shown in FIG. 2 while pulling a fluid film on the face 21 free from the drop, which fluid film is continuously replenished from the tube 20, and the film is thrown centrifugally in atomized droplets from the periphery of the disk onto the heated vaporizing surface 18. The droplets will be thrown from the disk surface 21 along the path lines 22 illustrated in FIG. 4.

The desired phenomenon can best be understood by considering other effects which result from different arrangements. If the end of the capillary tube 20 is spaced well clear of the disk surface 21, drops will be formed that periodically release and fall onto the disk. The resulting vaporization would thus also be in periodic bursts, and there would not be uniform vapor delivery from the apparatus 10. Condensation and the resulting coating on the substrate 12 would therefore not be uniform.

If the drop at the end of the capillary tube 20 is brought into contact with a stationary surface, or a surface having no uniform direction such as the center of the spinning circular disk 15, the phenomenon illustrated in FIG. 5 occurs. Here, it is assumed that the capillary tube 20 is positioned over the center of the circular surface 21. The initial drop contacts the surface 21 and, as soon as the surface is wetted, the fluid flow is continuous from the tube 20 until the reservoir 11 is emptied or the fluid supply is otherwise cut off. Assuming that the liquid is being delivered to the center of a spinning disk, liquid will be delivered from the disk periphery but in uneven splashes and at a rate in excess of that desired for condensating a thin film.

Figure 3:
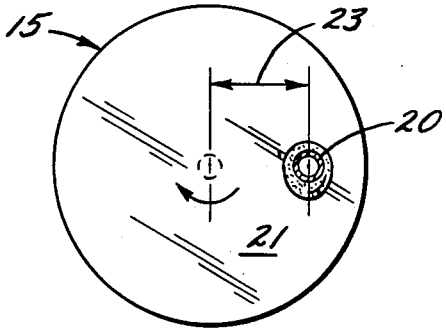
FIG. 3 is a top view, with a portion sectioned, of the structure shown in FIG. 2.

However, if the tube 20 is initially positioned near the center of the spinning disk 15 and then moved peripherally outward so as to gradually increase the speed of the surface contacting the drop, the condition described above and illustrated in FIG. 2 will be reached. Representative relationships found suitable for a monomeric liquid resin included a 20 mil capillary tube feeding liquid to a disk 1" in diameter driven in the 3,000 to 5,000 rpm range. The formed drop, depending upon the liquid's viscosity and surface tension, contacted the disk with the tube and spaced about 37 mils from the disk. The disk was formed of clean glass. The drop rolling and film forming phenomenon was achieved with the spacing 23 (see FIG. 3) of the drop from the disk center being about ⅜". Droplets produced and discharged along the paths 22 were estimated as being 5 mils in diameter.

While the disk surface 21 has been illustrated as horizontal with the tube at a vertical right angle, the surface 21 can be disposed vertically and the tube horizontal so long as the tube is positioned so that the drop contacts the upwardly driven half of the disk surface. So disposed, the viscosity pull of the disk on the liquid counteracts the gravity pull.

The arrangement described produces a very low rate of droplet formation well suited for subsequent flash vaporization and deposition of a very thin coating layer. The vapor delivery rate can be increased, if desired, by pressurizing the reservoir 11. Liquids of varying viscosity would produce initial droplets of varying size depending upon the size of the capillary tube, but the disk and tube relative spacing could obviously be readily varied to accommodate varying drop sizes.

It can also be readily appreciated that the components making up the apparatus 10 are relatively simple and straightforward so that the apparatus is inexpensive to manufacture and maintain.

I claim as my invention:

1. A liquid atomizing device comprising, in combination, a disk having a flat circular face mounted for rotation, means for rotatably driving said disk, a fluid conveying capillary tube mounted for delivering fluid to said face at a low but constant flow rate, a reservoir for supplying fluid to be atomized to said tube, the fluid delivering end of said tube being spaced from said face so that a liquid drop formed at the tube end is just contacted by the face and the face rotation rotates the drop while pulling a thin, uniform, continuous fluid film on the face from the drop, wherein the liquid is a monomeric liquid resin, the disk is formed of glass and has a one-inch diameter, the means for rotatably driving said disk rotates it about its center at a rate within the range of about 3000 to about 5000 revolutions per minute, and the capillary tube is a 20 mil capillary tube and is mounted to deliver fluid to said face at a point radially spaced about ⅜ inch from the center of the disk, whereupon said film is thrown in atomized droplets from the periphery of the disk.

2. A liquid vaporizing apparatus for vacuum vapor deposition of a material from liquid monomer form comprising, in combination, a vaporization chamber having a nozzle opening for discharging vapor, a one-inch diameter, glass disk having a flat circular face mounted for rotation in said chamber, means for rotatably driving said disk about its center at a rate within the range of about 3000 to about 5000 revolutions per minute, a 20 mil, fluid conveying capillary tube mounted in said chamber for delivering fluid to said face at a low but constant flow rate and at a point radially spaced about ⅜ inch from the center of the disk, a reservoir for supplying fluid to be atomized to said tube, the fluid delivering end of said tube being spaced from said face so that a liquid drop formed at the tube end is just contacted by the face and the face rotation rotates the drop while pulling a thin, uniform, continuous fluid film having a thickness of about one micron or less on the face from the drop, a band heater in said chamber defining a heating surface surrounding the periphery of said disk, whereby said film is thrown in atomized droplets from the periphery of said disk and said droplets are flash vaporized on said surface.

* * * * *